US007314349B2

(12) United States Patent
Mills

(10) Patent No.: US 7,314,349 B2
(45) Date of Patent: Jan. 1, 2008

(54) FLUID LEVEL CONTROL SYSTEM FOR PROGRESSIVE CAVITY PUMP

(75) Inventor: Manuel D. Mills, Midland, TX (US)

(73) Assignee: Djax Corporation, Midland, TX (US)

( * ) Notice: Subject to any disclaimer, the term of this patent is extended or adjusted under 35 U.S.C. 154(b) by 652 days.

(21) Appl. No.: 10/831,054

(22) Filed: Apr. 26, 2004

(65) Prior Publication Data

US 2005/0238495 A1 Oct. 27, 2005

(51) Int. Cl.
*F04B 49/06* (2006.01)

(52) U.S. Cl. ..... 417/42; 417/44.1; 417/53

(58) Field of Classification Search ..... 417/22, 417/42, 44.1, 53

See application file for complete search history.

(56) References Cited

U.S. PATENT DOCUMENTS 4,145,161 A * 3/1979 Skinner ..... 417/22
4,490,094 A 12/1984 Gibbs
4,873,635 A 10/1989 Mills
5,291,777 A 3/1994 Chang et al.
5,372,482 A 12/1994 London et al.
5,458,466 A * 10/1995 Mills ..... 417/44.1
6,085,836 A 7/2000 Burris et al.
6,456,201 B1 9/2002 Mioduszewski et al.
6,481,499 B2 11/2002 Lopes
6,536,522 B2 * 3/2003 Birckhead et al. ..... 166/250.15
6,554,066 B2 4/2003 Lopes
6,890,156 B2 * 5/2005 Watson et al. ..... 417/42
2004/0062658 A1 * 4/2004 Beck et al. ..... 417/42
2005/0095140 A1 * 5/2005 Boren et al. ..... 417/42

* cited by examiner

*Primary Examiner*—Michael Koczo, Jr.
(74) *Attorney, Agent, or Firm*—Browning Bushman P.C.

(57) ABSTRACT

A control system controls a progressive cavity pump driven by a rod. The rod is powered by a prime mover, such as a variable speed drive. A proximity sensor outputs signals responsive to rotational positioning of the rod. A controller receives the signals and computes a time interval between selected signals corresponding to a selected number of rod rotations. The controller references a data set, compares the computed time interval with the data set, and selectively increases, decreases, or cycles power to the prime mover in response thereto, thereby controlling the fluid level within the well.

25 Claims, 2 Drawing Sheets

FLUID LEVEL CONTROL SYSTEM FOR PROGRESSIVE CAVITY PUMP

FIELD OF THE INVENTION

This invention relates generally to pump controllers for downhole pumps used in the hydrocarbon recovery industry. More specifically, this invention relates to a control system for controlling a progressive cavity pump to control fluid level within a well.

BACKGROUND OF THE INVENTION

In the hydrocarbon recovery industry, pumps are used at the lower ends of wells to pump water or oil to the surface through production tubing positioned within a well casing. The production tubing is generally positioned within a casing, with an annulus formed therebetween. Fluid from the formation enters the annulus and is pumped upwardly through the production tubing. Power is transmitted to the pump from the surface using a rod string positioned within the production tubing. Rod strings include both "reciprocating" types, which are axially stroked, and "rotating" types for use with progressive cavity pumps, which rotate to power progressing cavity pumps.

As to both reciprocating and rotating type pumps, if the rate of pumping exceeds the rate of supply by the formation, fluid level in the annulus will be lowered. If the fluid level drops too low, and especially if the fluid level falls below the upper end of the pump, the pump can be damaged. Likewise, if the rate of supply by the formation exceeds the rate of pumping, fluid level will rise. If the fluid level is too high, however, the well is not producing at maximum capacity, and production revenues are not maximized. There is accordingly a trade-off between pumping at high and low fluid levels.

Some systems have been proposed for timing pump strokes of a reciprocating type rod. U.S. Pat. No. 4,873,635 to Mills discloses a pump-off control device for use with a reciprocating type rod. The device measures the length of time required for the pump to downstroke successive numbers of times, and when the time differential reaches a predetermined value, the well is shut in for a time interval. U.S. Pat. No. 4,490,094 discloses a method whereby instantaneous speeds of revolution for a beam pumping unit prime mover rotor are compared to predetermined values to correct pumping unit operation, such as during pump-off, mechanical malfunction, electrical operating inefficiency, or pumping unit imbalance. These systems are limited to use with reciprocating type pumps.

Particularly as to progressive cavity pumps coupled with rotating rod strings, as fluid level in the annulus drops, the hydrostatic pressure is reduced and the prime mover must work harder. Conversely, a higher fluid level increases hydrostatic pressure, which assists a progressive cavity pump by reducing the "head," which is a spacing between the fluid level and the surface.

Production from the well can be optimized if the fluid level is maintained at a certain value or range of values. The prior art discloses a number of approaches to detecting fluid level. For example, U.S. Pat. No. 6,085,836 discloses a method of transmitting sonic signals into the annulus to determine fluid level. U.S. Pat. No. 5,372,482 discloses a way to monitor fluid level indirectly from variation in the power consumption of an electrical motor. This patent eliminates the need for downhole pressure sensors and amperage monitors.

In recent years, gas producing companies have discovered that gas can be profitably produced by drilling into coal beads and pumping out the water. Lowering the hydrostatic head pressure by removing the water permits the gas to flow to the surface.

The progressive cavity pump has been found to be a very cost effective way to remove the water from these coal sands and to lower hydrostatic head pressure. The fluid level in the annulus above the progressive cavity pump needs to be controlled at a level that always gives sufficient pump submergence. If there is insufficient pump submergence the progressive cavity pump can be damaged or destroyed, which is expensive to repair or replace.

Other patents of intest include U.S. Pat. Nos. 6,456,201; 6,481,499; 6,554,066; and 5,291,777.

SUMMARY OF THE INVENTION

A control system controls a progressive cavity pump downhole in a well having a variable fluid level. The pump is driven by a rotating rod, which extends through a tubular to the pump and is powered by a prime mover at the surface. A proximity sensor outputs signals responsive to rotational positioning of the rod. A controller receives the signals and computes a time interval between selected signals corresponding to a selected number of rod rotations. The controller references a data set, compares the computed time interval with the data set, and controls power to the prime mover in response thereto, thereby controlling the fluid level within the well.

The present invention will control the fluid level at an optimum level above the pump, increasing production and preventing the likelihood of damaging the pump. The prime mover may be a variable power drive and the controller may selectively signal the variable power drive to increase or decrease power to increase or decrease the rotation rate of the rod. Alternatively, the prime mover may operate within a substantially continuously variable range of power settings and the controller may signals the prime mover to selectively adjust the power within the range of power settings. The prime mover need not be a variable power drive, and the controller may instead power on or power off the prime mover to adjust the fluid level in the well. This concept of control will eliminate expensive downhole pressure sensors and temperature monitors on conductive wires.

The foregoing is intended to summarize the invention, and not to limit nor fully define the invention. The aspects of the invention will be more fully understood and better appreciated by reference to the following description and drawings.

DETAILED DESCRIPTION OF THE PREFERRED EMBODIMENTS

Figure 1:
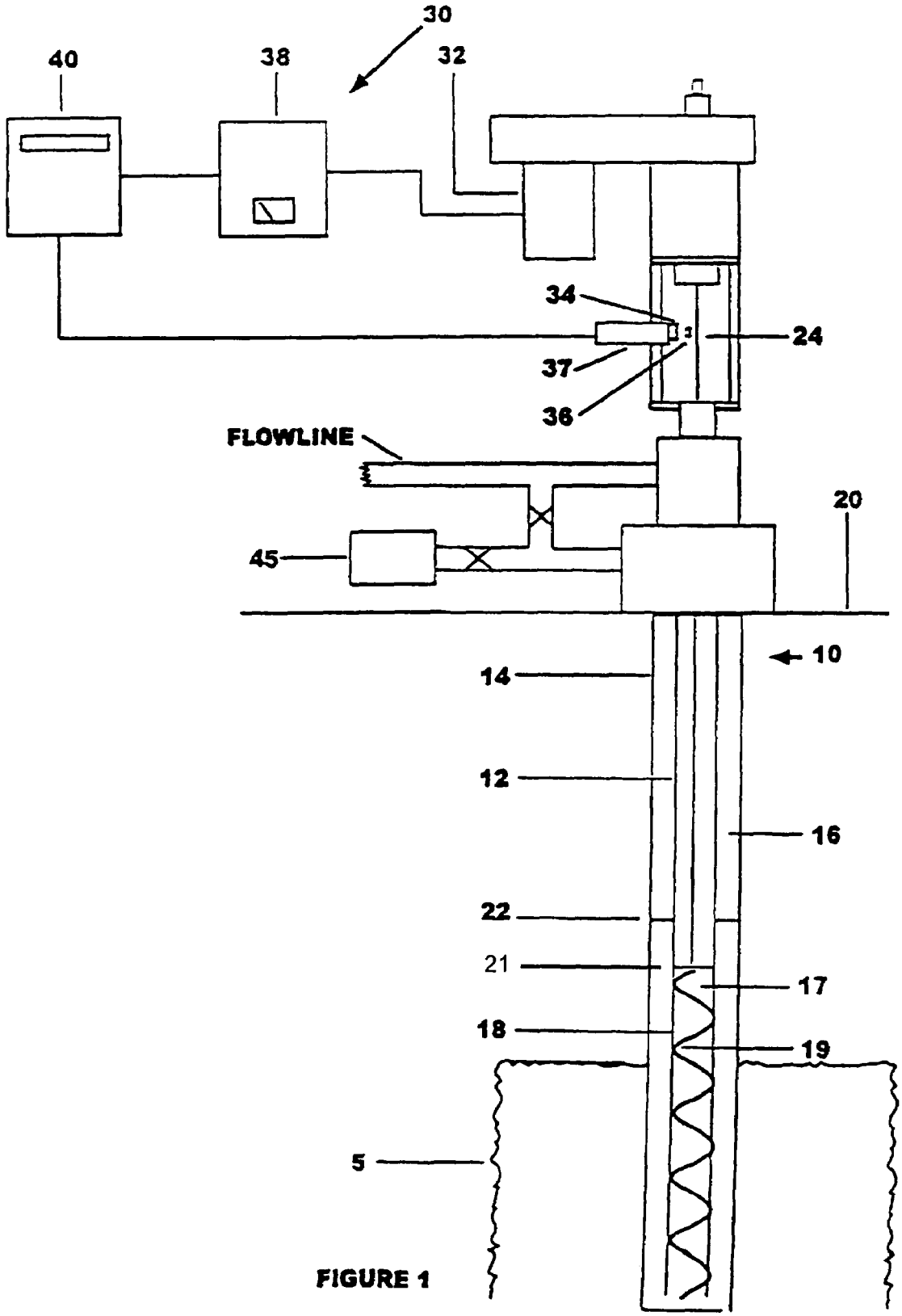
FIG. 1 schematically shows a control system for a hydrocarbon production well including a production tubing disposed within a casing and a downhole progressive cavity pump.

FIG. 1 schematically shows a hydrocarbon recovery well indicated generally at 10 passing through an oil-bearing formation 5. A production tubing or tubular 12 is disposed within a casing 14, with an annulus 16 formed therebetween.

Fluid from the formation 5 passes into the annulus 16. A progressive cavity pump 18 is positioned downhole for pumping fluid from the annulus 16 upward through the interior of production tubing 12 to the surface 20. The progressive cavity pump 18 is the type of pump powered by rotation (rather than reciprocation) of a rod string 24. A variable level fluid column 21 results in the annulus 16.

The "head" is defined as the distance from the top 22 of the variable-level fluid column 21 to the surface 20. The lower the head (i.e. the higher the top 22 of the fluid column 21), the less the pump 18 must work to pump fluid to the surface 20. This is because the hydrostatic pressure of the fluid column 21, which is a function of the height of the fluid column 21, effectively "assists" the pump 18. If the fluid level gets too low, the pump 18 may be operating inefficiently because of the higher power requirement at low fluid levels. If the fluid level drops to the fluid intake of the pump 18, such as when the pump 18 has been operating too fast, the pump 18 will likely be destroyed. Conversely, the well 10 is not operating at capacity when the fluid level is too high. Thus, there can be ascertained an "optimum fluid level" whereby operation of the well 10 is optimized. More practically, a range of acceptable fluid level can be ascertained. A goal of a prudent well operator is to operate the well 10 as close to the optimum fluid level as possible, or at least within the acceptable range, to maximize production without consuming excessive power or damaging the pump 18.

FIG. 1 further illustrates a preferred embodiment of a control system, indicated generally at 30, for controlling the progressive cavity pump 18 in the well 10 as shown in FIG. 1. A prime mover 32, which is preferably an electrically-operated or fluid-operated variable speed drive 32, drives rotation of the rod 24. A sensor 34 is positioned adjacent the rod 24. The sensor 34 outputs signals responsive to rotational positioning of the rod 24 at a preselected rotational position of the rod 24. More particularly, as shown, the sensor 34 comprises a proximity sensor having a first member 36 secured to the rod 24 for rotating with the rod 24, and a stationary second member 37 structurally separate from the first member 36 for sensing the proximity of the first member 36 at the rotational position shown. The rotational position at which the rotating first member 36 is aligned with the stationary second member 37 is selected to be reached with every 360-degree rotation of the rod 24. The sensor 34 outputs a signal to a controller 40 whenever the rod 24 reaches this rotational position. The controller 40 receives the signals and computes a time interval between selected signals, such as between one or more revolutions of the rod 24. The controller 40 then references a data set (discussed further below), which is preferably included within operating software of the controller 40, compares the computed time interval to the data set, and controls power to the prime mover 32 in response.

When the prime mover 32 is a variable speed drive, the controller 40 may selectively signal the prime mover 32 to increase or decrease power to increase or decrease rotation rate of the rod 24. Although increasing or decreasing power will speed up or slow down rotation of the rod 24, the rod 24 will not likely remain precisely at that increased or decreased rotation rate, because the rotation rate of the rod 24 is not simply a function of the power output of the prime mover 32 alone. This is because the variable height of the fluid column 21 results in the variable amount of head discussed above, which in turns provides variable resistance to the pump 18. Thus, for a given amount of power output from the prime mover 32, the rotation rate of the rod 24 will also depend to some extent on the height of fluid column 21. For example, if fluid level is too high, the power to the prime mover 32 can be increased, and the rotation rate of the rod 24 will increase temporarily to pump out fluid faster. However, the rod rotation rate will gradually slow, even at the increased power, as the fluid column 21 is drawn downward.

Fortunately, it can be determined in advance with reasonable reliability that the fluid column 21 can be maintained at a fairly constant level corresponding to a constant rod rotation rate. Preferably using portable ultrasonic level calibration equipment conceptually illustrated at 45, each well can be calibrated by ascertaining the rod rotation rate required to maintain the fluid column 21 at a certain height. Thus, rotation rates required to maintain the fluid column 21 within the maximum and minimum fluid levels, and/or at the optimum fluid level discussed above, may be determined experimentally using the sonic well equipment. This information may be incorporated as time-related reference parameters within the data set of the controller 40. In one embodiment, the data set may include a rotation rate (RPMs) for each of the desired fluid levels (e.g. maximum/minimum or optimum). The controller 40 may compute the actual rotation rate of the rod as a function of the computed time interval and corresponding number of rod rotations. The controller 40 may then compare the actual rotation rate to the data set. For example, in a "2-setting" embodiment, if the actual rotation rate falls below the optimum rate, the controller 40 may signal the prime mover 32 to increase power to an upper power setting. Similarly, the controller 40 may signal the prime mover 32 to increase power to the upper power setting when/if rotation rate falls below the minimum, or decrease power to a lower power setting when/if the rotation rate rises above the maximum. In other embodiments, the data set need not specifically include reference rotation rates. The data set may instead include other time-related parameters such as reference time intervals, measured as the time intervals required for the rod to rotate a certain number of revolutions at respective rotation rates corresponding to the various fluid levels.

EXAMPLE

The prime mover has an upper and lower power setting. The controller is set up to measure a time interval for 30 rod revolutions. Using an ultrasonic level detector to calibrate the well, the "optimum" fluid level is predetermined to be 300 feet, at which the rod rotation rate is 400 RPM. For 30 revolutions at 400 RPM (optimum), the time interval is 4.5 seconds (4500 ms). Thus, one value in the data set is the time interval of 4500 ms. Similarly, the maximum fluid level corresponds to a time interval of 4520 ms and the minimum fluid level corresponds to 4480 ms (a time difference "delta-t" of +/−20 ms). These values may also be programmed into the controller. After calibration, the control system is ready for operation. The controller will "know" to decrease power when the time interval rises above 4520 ms and increase power when the time interval drops below 4480 ms. For instance, if the prime mover is operating at the lower power setting and the measured time interval reaches 4522 ms, the controller will compare this to the data set, determine the delta-t has been exceeded, and signal the prime mover to increase power to the upper power setting to lower the fluid level and a corresponding time interval of 4500 ms.

Although the above example is idealized, it illustrates the logic and functionality of one embodiment of the control system. It further illustrates the importance of measuring the time interval for a plurality of revolutions, because even at 30 revolutions a delta-t of 20 ms corresponds to a difference of only about +/−2 RPM.

In a less preferred "on/off" type embodiment, the prime mover 32 may instead be cycled on and off. Turning off power will stop the pump by halting rotation of the rod 24, allowing the fluid column 21 to rise. Turning the power back on will draw the fluid column 21 back downward. The powered-on pump 18 can remain on until the controller 40 determines the column 21 has dropped below the optimal or minimum fluid levels, via the logic discussed above.

In a "continuously variable" embodiment, the prime mover 32 may have a continuously variable power range, and a more sophisticated logic circuit within controller 40 may signal the prime mover 32 not only to simply increase or decrease power, but to increase or decrease power by a certain increment. For example, if the comparison of actual time intervals to the referenced data set reveals the fluid level is only slightly above the optimum level, the controller 40 may signal the prime mover 32 to increase power by only a small increment.

In all embodiments discussed, the prime mover 32 may include a power gauge 38 to indicate power to the prime mover 32. For example, in the on/off embodiment, the gauge 38 may simply indicate power is on or off. In the 2-setting embodiment, the gauge may indicate whether the prime mover 32 is at the upper power setting (such as "60 Hz") or the lower power setting (such as "50 Hz"). In the continuously variable embodiment, the gauge 38 may indicate the specific power setting within the continuously variable range.

Although not preferred, rotational positions in some embodiments could be spaced at less than 360 degrees. For example, if the first member 36 included two pieces (not shown) directly opposite one another with respect to the rod 24, the rotational positions would be spaced at 180 degrees, and two rotational positions could be included within every 360-degree rotation of the rod 24. Furthermore, the time intervals need not be computed between 2 consecutive signals. To obtain better resolution, the time interval could be computed over multiple revolutions of the rod 24. For instance, computing the time interval over a selected number of 10-30 revolutions will likely result in a more accurate and meaningful computation of rotation rate, because the difference in time for only a few revolutions at the maximum or minimum fluid level may not be detectable. Selecting too high a number of revolutions, such as 500 revolutions, is generally not advisable, because by the time the rod 24 rotates that many revolutions, it may be too late to adjust the power setting.

Figure 2:
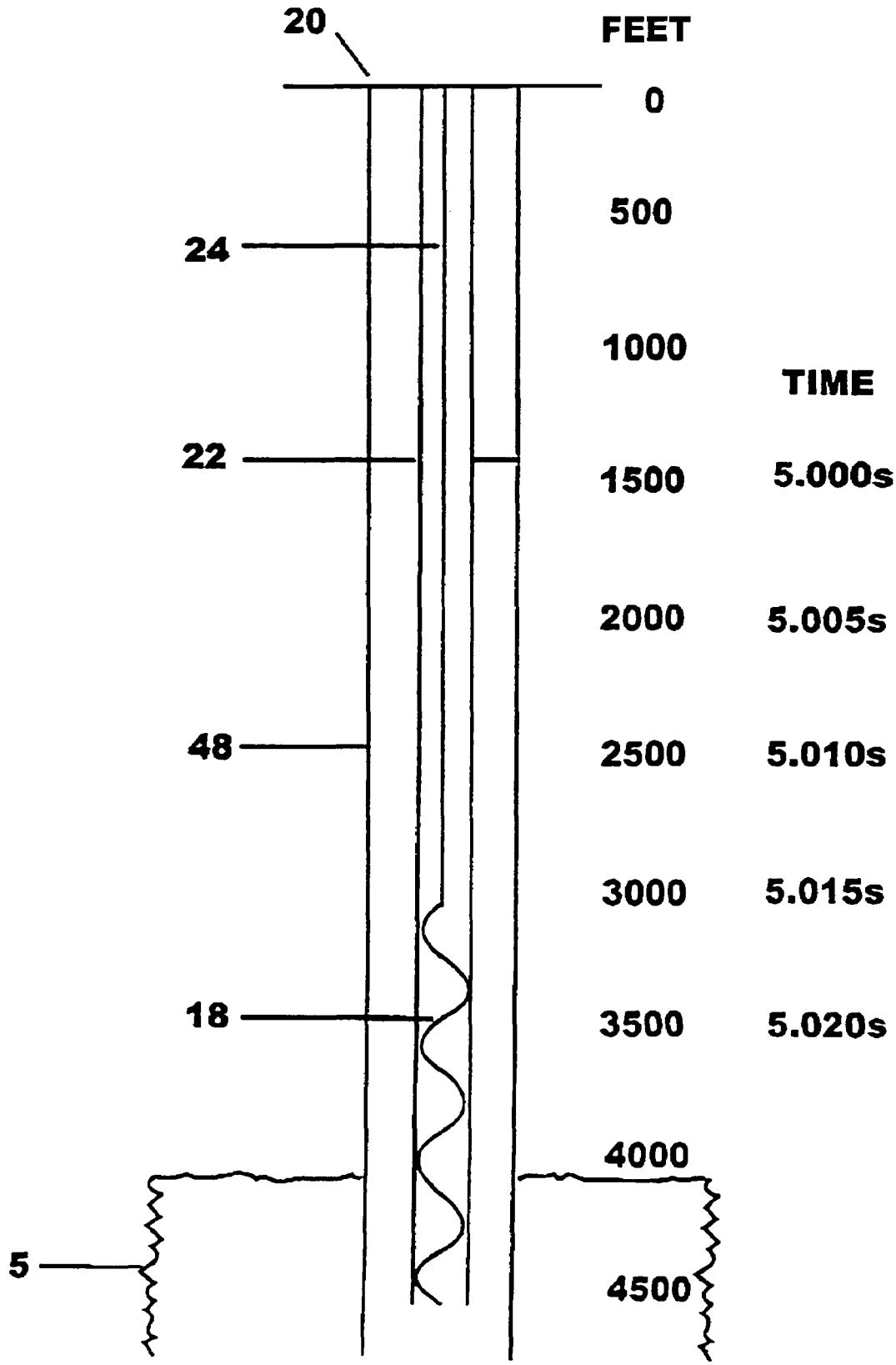
FIG. 2 illustrates a typical fluid level/time chart for controlling a progressive cavity pump as shown in FIG. 1.

FIG. 2 illustrates the fluid level in a well, wherein the top of the fluid level 22 is at approximately 1400 feet and the target fluid level 48 is approximately 2500 feet. Next to specific depth indications is a detected time in seconds for a specific number of rod revolutions. With a decreasing depth level, the time increases by 0.5 milliseconds with each additional 500 feet in depth. FIG. 2 may thus be used by the operator to maintain a target fluid level 48 of approximately 2500 feet in response to the measured time for the rod to rotate a specific number of turns. Although specific embodiments of the invention have been described herein in some detail, this has been done solely for the purposes of explaining the various aspects of the invention, and is not intended to limit the scope of the invention as defined in the claims which follow. Those skilled in the art will understand that the embodiments shown and described are exemplary, and various other substitutions, alterations, and modifications, including but not limited to those design alternatives specifically discussed herein, may be made in the practice of the invention without departing from its scope.

The invention claimed is:

1. A control system for controlling a progressive cavity pump downhole in a well having a variable fluid level, the pump driven by a rotating rod powered by a prime mover, the rod extending through a tubular to the pump, the pump for pumping fluid upward through the tubular, the control system comprising:

a sensor for outputting signals responsive to rotational positioning of the rod;

a controller for receiving the signals, computing a time interval between selected signals corresponding to a selected number of rod rotations, referencing a data set, comparing the computed time interval with the data set, and controlling power to the prime mover in response thereto, thereby controlling the fluid level within the well.

2. A control system as defined in claim 1, wherein the prime mover includes a variable power drive and the controller selectively signals the prime mover to adjust power to increase or decrease the rotation rate of the rod.

3. A control system as defined in claim 2, wherein the controller selectively signals the prime mover to operate at a discrete upper power setting to increase the rotation rate of the rod and thereby decrease the fluid level or to operate at a discrete lower power setting to decrease the rotation rate of the rod and thereby increase the fluid level.

4. A control system as defined in claim 2, wherein the prime mover comprises a range of multiple power settings and the controller signals the prime mover in response to the computed time interval to selectively adjust the power within the range of power settings.

5. A control system as defined in claim 1, wherein the controller selectively powers on or powers off the prime mover to adjust the fluid level in the well.

6. A control system as defined in claim 1, wherein the sensor comprises:

a proximity sensor having a first member secured to the rod for rotating with the rod and a second member structurally separate from the rod, such that as the rod rotates to the selected rotational position the first member passes in proximity to the second member and the second member senses the proximity of the first member, the second member outputting the signals in response thereto.

7. A control system as defined in claim 1, wherein the data set comprises one or more predetermined time intervals each corresponding to rotation of the rod through a predetermined number of revolutions at a rotation rate corresponding to a predetermined fluid level.

8. A control system as defined in claim 1, wherein the data set comprises one or more of a time-related lower parameter corresponding to the rod rotation rate at a selected minimum fluid level and a time-related upper parameter corresponding to the rod rotation rate at a selected maximum fluid level, and the controller controls power to maintain the fluid level between the minimum and maximum fluid level.

9. A control system as defined in claim 8, wherein the maximum and minimum fluid levels are predetermined with an ultrasonic level detector while the rod is rotating at corresponding rotation rates.

10. A control system as defined in claim 1, wherein the data set comprises a selected optimum level, and the controller controls power to maintain the fluid level within a selected range of fluid levels above and below the optimum level.

11. A control system as defined in claim 1, wherein the controller measures the time interval for a plurality of revolutions of the rod.

12. A control system as defined in claim 11, wherein the controller measures the time interval for at least 10 revolutions of the rod.

13. A control system for controlling a progressive cavity pump downhole in a well having a variable fluid level, the pump driven by a rotating rod powered by a variable power drive, the rod extending through a tubular to the pump, the pump for pumping fluid upward through the tubular, the control system comprising:

a proximity sensor having a first member secured to the rod for rotating with the rod and a second member structurally separate from the rod, such that as the rod rotates to a selected rotational position the first member passes in proximity to the second member and the second member senses the proximity of the first member, the second member outputting signals in response thereto;

a controller for receiving the signals, computing a time interval for a plurality of revolutions of the rod, referencing a data set, comparing the computed time interval with the data set, and selectively signaling the prime mover to increase or decrease power to increase or decrease rotation rate of the rod.

14. A control system as defined in claim 13, wherein the controller selectively signals the prime mover to operate at a discrete upper power setting to increase the rotation rate of the rod and thereby decrease the fluid level or to operate at a discrete lower power setting to decrease the rotation rate of the rod and thereby increase the fluid level.

15. A control system as defined in claim 13, wherein the prime mover comprises a substantially continuously variable range of power settings and the controller signals the prime mover in response to the computed time interval to selectively adjust the power within the range of power settings.

16. A control system as defined in claim 13, wherein the data set comprises one or more predetermined time intervals each corresponding to rotation of the rod through a predetermined number of revolutions at a respective rotation rate corresponding to a predetermined fluid level.

17. A control system as defined in claim 13, wherein the data set comprises one or more of a time-related lower parameter corresponding to the rotation rate at a selected minimum fluid level and a time-related upper parameter corresponding to the rotation rate at a selected maximum fluid level, and the controller controls power to maintain the fluid level between the minimum and maximum fluid level.

18. A method of controlling a progressive cavity pump downhole in a well having a variable fluid level, the pump driven by a rotating rod powered by a prime mover, the rod extending through a tubular to the pump, the pump for pumping fluid upward through the tubular, the control system comprising:

using a sensor to output signals responsive to rotational positioning of the rod at a preselected rotational positions;

receiving the signals and computing a time interval between selected signals corresponding to a selected number of rod rotations; and referencing a data set, comparing the computed time interval with the data set, and controlling power to the prime mover in response thereto, thereby controlling the fluid level within the well as a function of the fluid level.

19. A method as defined in claim 18, wherein the prime mover is a variable power drive and controlling power to the prime mover comprises:

selectively signaling the prime mover to increase or decrease power to increase or decrease the rotation rate of the rod.

20. A method as defined in claim 19, wherein controlling power to the prime mover further comprises:

selectively signaling the prime mover to either operate at a discrete upper power setting to increase the rotation rate of the rod and thereby decrease the fluid level or to operate at a discrete lower power setting to decrease the rotation rate of the rod and thereby increase the fluid level.

21. A method as defined in claim 18, wherein the prime mover comprises a substantially continuously variable range of power settings and controlling power to the prime mover further comprises:

signaling the prime mover in response to the computed time interval to selectively adjust the power within the range of power settings.

22. A method as defined in claim 18, wherein controlling power to the prime mover further comprises:

selectively powering on or powering off the prime mover to adjust the fluid level in the well.

23. A method as defined in claim 18, wherein the data set comprises one or more predetermined rod rotation rates corresponding to rotation of the rod at predetermined fluid levels, and controlling power to the prime mover further comprises:

computing an actual rotation rate from the computed time interval and the selected number of rotations and comparing the actual rotation rate to the one or more predetermined rod rotation rates.

24. A method as defined in claim 23, further comprising:

predetermining the maximum and minimum fluid levels with an ultrasonic level detector while the rod is rotating at corresponding rotation rates.

25. A method as defined in claim 1, wherein the data set comprises a selected optimum level, and controlling power to the prime mover further comprises:

controlling power to maintain the fluid level within a range of fluid levels above and below the optimum level.

* * * * *